US008944618B2

(12) United States Patent
Tseng et al.

(10) Patent No.: US 8,944,618 B2
(45) **Date of Patent: *Feb. 3, 2015**

(54) LED-BASED ILLUMINATION MODULES WITH PTFE COLOR CONVERTING SURFACES

(75) Inventors: Peter K. Tseng, San Jose, CA (US); Gerard Harbers, Sunnyvale, CA (US)

(73) Assignee: Xicato, Inc., San Jose, CA (US)

( * ) Notice: Subject to any disclaimer, the term of this patent is extended or adjusted under 35 U.S.C. 154(b) by 33 days.

This patent is subject to a terminal disclaimer.

(21) Appl. No.: 13/559,522

(22) Filed: Jul. 26, 2012

(65) Prior Publication Data

US 2012/0287623 A1 Nov. 15, 2012

Related U.S. Application Data

(63) Continuation of application No. 13/223,223, filed on Aug. 31, 2011, now Pat. No. 8,297,767.

(60) Provisional application No. 61/380,672, filed on Sep. 7, 2010.

(51) Int. Cl.
*F21V 9/16* (2006.01)
*F21V 7/22* (2006.01)
(Continued)

(52) U.S. Cl.
CPC ... *F21V 7/22* (2013.01); *F21K 9/54* (2013.01); *F21K 9/56* (2013.01); *F21Y 2101/02* (2013.01); *Y10S 362/80* (2013.01)
USPC ..... 362/84; 362/184; 362/230; 362/249.02; 362/601; 362/800

(58) Field of Classification Search
CPC ..... F21K 9/54; F21K 9/56; F21V 7/22; F21Y 2101/02
USPC ..... 362/1, 2, 84, 601, 509, 510, 166, 227, 362/230, 231, 249.02, 293, 800
See application file for complete search history.

(56) References Cited

U.S. PATENT DOCUMENTS 5,959,316 A 9/1999 Lowery
6,351,069 B1 2/2002 Lowery et al.
(Continued)

FOREIGN PATENT DOCUMENTS

CN 1880839 A 12/2006
CN 100559066 C 11/2009
(Continued)

OTHER PUBLICATIONS

U.S. Appl. No. 13/223,223, filed Aug. 31, 2011 by Xicato, Inc., 49 pages.
(Continued)

*Primary Examiner* — Stephen F Husar
*Assistant Examiner* — Danielle Allen
(74) *Attorney, Agent, or Firm* — Silicon Valley Patent Group LLP

(57) ABSTRACT

An illumination module includes a plurality of Light Emitting Diodes (LEDs) and a light conversion sub-assembly mounted near but physically separated from the LEDs. The light conversion sub-assembly includes at least a portion that is a polytetrafluoroethylene (PTFE) material that also includes a wavelength converting material. Despite being less reflective than other materials that may be used in the light conversion sub-assembly, the PTFE material unexpectedly produces an increase in luminous output, compared to other more reflective materials, when the PTFE material includes a wavelength converting material.

20 Claims, 10 Drawing Sheets

(51) Int. Cl.
*F21K 99/00* (2010.01)
*F21Y 101/02* (2006.01)

(56) References Cited

U.S. PATENT DOCUMENTS

| | | | | |
|---|---|---|---|---|
| 6,504,301 | B1 | 1/2003 | Lowery | |
| 6,586,882 | B1 | 7/2003 | Harbers | |
| 6,600,175 | B1 | 7/2003 | Baretz et al. | |
| 6,680,569 | B2 | 1/2004 | Mueller-Mach et al. | |
| 6,812,500 | B2 | 11/2004 | Reeh et al. | |
| 7,126,162 | B2 | 10/2006 | Reeh et al. | |
| 7,250,715 | B2 | 7/2007 | Mueller et al. | |
| 7,293,908 | B2 * | 11/2007 | Beeson et al. | 362/612 |
| 7,479,662 | B2 | 1/2009 | Soules et al. | |
| 7,564,180 | B2 | 7/2009 | Brandes | |
| 7,614,759 | B2 | 11/2009 | Negley | |
| 7,629,621 | B2 | 12/2009 | Reeh et al. | |
| 7,654,681 | B2 * | 2/2010 | Kim et al. | 362/97.4 |
| 7,791,096 | B2 | 9/2010 | Craford et al. | |
| 7,906,904 | B2 | 3/2011 | Kawae et al. | |
| 8,297,767 | B2 | 10/2012 | Tseng et al. | |
| 8,297,797 | B2 * | 10/2012 | Kim et al. | 362/294 |
| 2003/0026096 | A1 * | 2/2003 | Ellens et al. | 362/231 |
| 2007/0081336 | A1 | 4/2007 | Bierhuizen et al. | |
| 2008/0100790 | A1 | 5/2008 | Kang et al. | |
| 2008/0176066 | A1 | 7/2008 | Chang et al. | |
| 2009/0050911 | A1 | 2/2009 | Chakraborty | |
| 2009/0103296 | A1 | 4/2009 | Harbers et al. | |
| 2009/0141474 | A1 | 6/2009 | Kolodin | |
| 2009/0166653 | A1 | 7/2009 | Weaver, Jr. et al. | |
| 2010/0123386 | A1 | 5/2010 | Chen | |
| 2012/0002396 | A1 | 1/2012 | Tseng et al. | |

FOREIGN PATENT DOCUMENTS

| | | | |
|---|---|---|---|
| TW | 535304 | B | 6/2003 |
| TW | 200831658 | A | 8/2008 |
| TW | 200915619 | A | 4/2009 |
| TW | 201026138 | A | 7/2010 |
| WO | WO 2009/125314 | A2 | 10/2009 |
| WO | WO 2009/146261 | A1 | 12/2009 |

OTHER PUBLICATIONS

Office Action mailed on Jan. 25, 2012 for U.S. Appl. No. 13/223,223, filed Aug. 31, 2011 by Xicato, Inc., 15 pages.
Response to Office Action mailed on Apr. 24, 2012 for U.S. Appl. No. 13/223,223, filed Aug. 31, 2011 by Xicato, Inc., 6 pages.
Notice of Allowance mailed on May 11, 2012 for U.S. Appl. No. 13/223,223, filed Aug. 31, 2011 by Xicato, Inc., 9 pages.
Issue Notification mailed on Oct. 10, 2012 for U.S. Appl. No. 13/223,223, filed Aug. 31, 2011 by Xicato, Inc., 1 page.
International Search Report and Written Opinion mailed on Jan. 31, 2012 for PCT Application No. PCT/US2011/050258 filed on Jan. 9, 2011 by Xicato, Inc., 11 pages.
Machine translation in English of Abstract for CN1880839 visited at < www.espacenet.com> on Jun. 11, 2014, 1 page.

* cited by examiner

LED-BASED ILLUMINATION MODULES WITH PTFE COLOR CONVERTING SURFACES

CROSS REFERENCE TO RELATED APPLICATIONS

This application is a continuation of U.S. patent application Ser. No. 13/223,223, filed Aug. 31, 2011, which, in turn, claims the benefit of U.S. Provisional Patent Application No. 61/380,672, filed Sep. 7, 2010, both of which are incorporated by reference herein in their entirety.

TECHNICAL FIELD

The described embodiments relate to illumination modules that include Light Emitting Diodes (LEDs).

BACKGROUND

The use of light emitting diodes in general lighting is still limited due to limitations in light output level or flux generated by the illumination devices. Illumination devices that use LEDs also typically suffer from poor color quality characterized by color point instability. The color point instability varies over time as well as from part to part. Poor color quality is also characterized by poor color rendering, which is due to the spectrum produced by the LED light sources having bands with no or little power. Further, illumination devices that use LEDs typically have spatial and/or angular variations in the color. Additionally, illumination devices that use LEDs are expensive due to, among other things, the necessity of required color control electronics and/or sensors to maintain the color point of the light source or using only a small selection of produced LEDs that meet the color and/or flux requirements for the application.

Consequently, improvements to illumination device that uses light emitting diodes as the light source are desired.

SUMMARY

An illumination module includes a plurality of Light Emitting Diodes (LEDs) and a light conversion sub-assembly mounted near but physically separated from the LEDs. The light conversion sub-assembly includes at least a portion that is a polytetrafluoroethylene (PTFE) material that also includes a wavelength converting material. Despite being less reflective than other materials that may be used in the light conversion sub-assembly, the PTFE material unexpectedly produces an increase in luminous output, compared to other more reflective materials, when the PTFE material includes a wavelength converting material.

In one implementation, an LED based illumination device includes a light source sub-assembly having a plurality of Light Emitting Diodes (LEDs) mounted in a first plane; and a light conversion sub-assembly mounted adjacent to the first plane and physically separated from the plurality of LEDs and configured to mix and color convert light emitted from the light source sub-assembly, wherein a first portion of the light conversion sub-assembly is a polytetrafluoroethylene (PTFE) material and an interior surface of the first portion includes a first type of wavelength converting material.

In another implementation, an apparatus includes a plurality of Light Emitting Diodes (LEDs) mounted to a mounting board; and a primary light mixing cavity configured to direct light emitted from the plurality of LEDs to an output window, wherein the output window is physically separated from the plurality of LEDs, and wherein a first portion of the cavity is a polytetrafluoroethylene (PTFE) material and an interior surface of the first portion includes a first type of wavelength converting material.

Further details and embodiments and techniques are described in the detailed description below. This summary does not define the invention. The invention is defined by the claims.

DETAILED DESCRIPTION

Reference will now be made in detail to background examples and some embodiments of the invention, examples of which are illustrated in the accompanying drawings.

Figure 1:
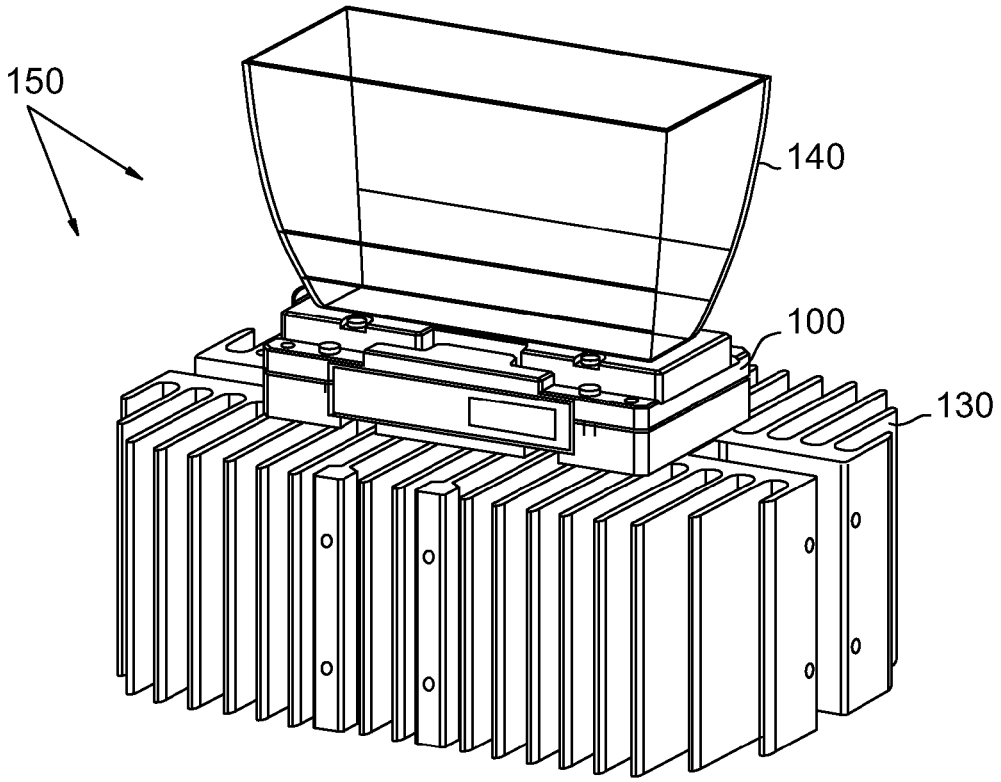
FIGS. 1 and 2 illustrate two exemplary luminaires, including an illumination device, reflector, and light fixture.
Figure 2:
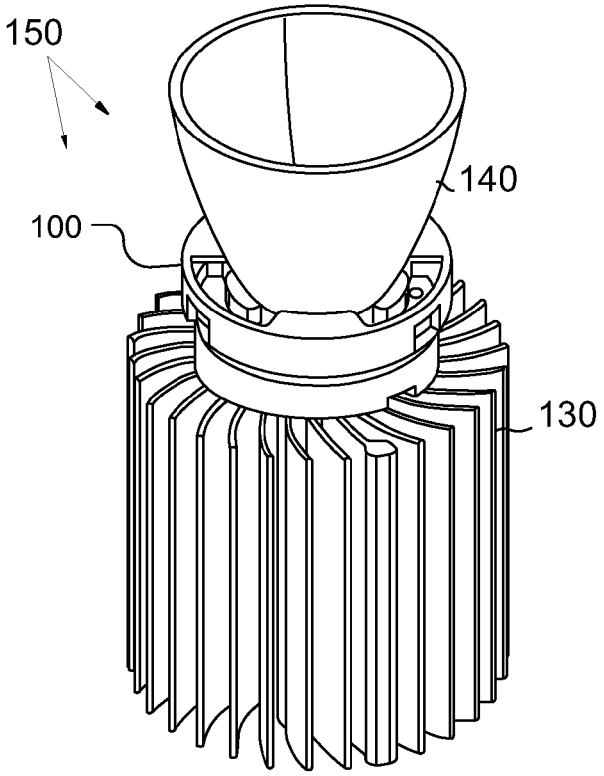

FIGS. 1 and 2 illustrate two exemplary luminaires. The luminaire illustrated in FIG. 1 includes an illumination module 100 with a rectangular form factor. The luminaire illustrated in FIG. 2 includes an illumination module 100 with a circular form factor. These examples are for illustrative purposes. Examples of illumination modules of general polygonal and elliptical shapes may also be contemplated. Luminaire 150 includes illumination module 100, reflector 140, and light fixture 130. As depicted, light fixture 130 is a heat sink and, thus, may sometimes be referred to as a heat sink 130. However, light fixture 130 may include other structural and decorative elements (not shown). Reflector 140 is mounted to illumination module 100 to collimate or deflect light emitted from illumination module 100. The reflector 140 may be made from a thermally conductive material, such as a material that includes aluminum or copper and may be thermally coupled to illumination module 100. Heat flows by conduction through illumination module 100 and the thermally conductive reflector 140. Heat also flows via thermal convection over the reflector 140. Reflector 140 may be a compound parabolic concentrator, where the concentrator is constructed of or coated with a highly reflecting material. Optical elements, such as a diffuser or reflector 140 may be removably coupled to illumination module 100, e.g., by means of threads, a clamp, a twist-lock mechanism, or other appropriate arrangement.

As depicted in FIGS. 1 and 2, illumination module 100 is mounted to heat sink 130. Heat sink 130 may be made from a thermally conductive material, such as a material that includes aluminum or copper and may be thermally coupled to illumination module 100. Heat flows by conduction through illumination module 100 and the thermally conductive heat sink 130. Heat also flows via thermal convection over heat sink 130. Illumination module 100 may be attached to heat sink 130 by way of screw threads to clamp the illumination module 100 to the heat sink 130. To facilitate easy removal and replacement of illumination module 100, illumination module 100 may be removably coupled to heat sink 130, e.g., by means of a clamp mechanism, a twist-lock mechanism, or other appropriate arrangement. Illumination module 100 includes at least one thermally conductive surface that is thermally coupled to heat sink 130, e.g., directly or using thermal grease, thermal tape, thermal pads, or thermal epoxy. For adequate cooling of the LEDs, a thermal contact area of at least 50 square millimeters, but preferably 100 square millimeters should be used per one watt of electrical energy flow into the LEDs on the board. For example, in the case when 20 LEDs are used, a 1000 to 2000 square millimeter heatsink contact area should be used. Using a larger heat sink 130 may permit the LEDs 102 to be driven at higher power, and also allows for different heat sink designs. For example, some designs may exhibit a cooling capacity that is less dependent on the orientation of the heat sink. In addition, fans or other solutions for forced cooling may be used to remove the heat from the device. The bottom heat sink may include an aperture so that electrical connections can be made to the illumination module 100.

Figure 3:
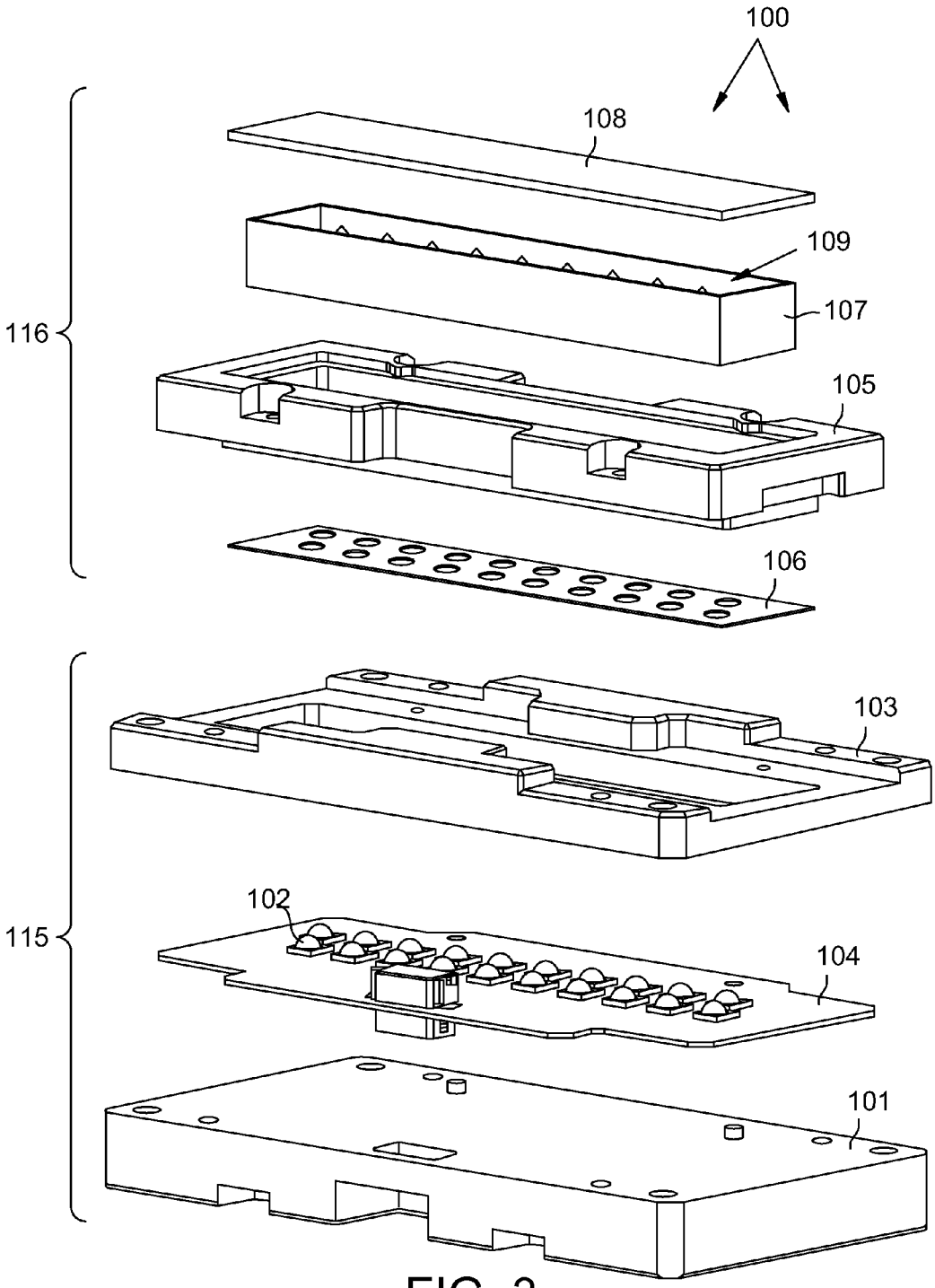
FIG. 3 shows an exploded view illustrating components of LED based illumination device as depicted in FIG. 1.

FIG. 3 illustrates an exploded view of components of LED based illumination module 100 as depicted in FIG. 1 by way of example. It should be understood that as defined herein an LED based illumination module is not an LED, but is an LED light source or fixture or component part of an LED light source or fixture. LED based illumination module 100 includes one or more LED die or packaged LEDs and a mounting board to which LED die or packaged LEDs are attached. LED based illumination module 100 includes one or more solid state light emitting elements, such as light emitting diodes (LEDs) 102 mounted on mounting board 104. Mounting board 104 is attached to mounting base 101 and secured in position by mounting board retaining ring 103. Together, mounting board 104 populated by LEDs 102 and mounting board retaining ring 103 comprise light source sub-assembly 115. Light source sub-assembly 115 is operable to convert electrical energy into light using LEDs 102. The light emitted from light source sub-assembly 115 is directed to light conversion sub-assembly 116 for color mixing and color conversion. Light conversion sub-assembly 116 includes cavity body 105 and an output port, which is illustrated as, but is not limited to, an output window 108. The light conversion sub-assembly 116 optionally includes either or both bottom reflector insert 106 and sidewall insert 107. Output window 108, if used as the output port, is fixed to the top of cavity body 105.

Either the interior sidewalls of cavity body 105 or sidewall insert 107, when optionally placed inside cavity body 105, is reflective so that light from LEDs 102, as well as any wavelength converted light, is reflected within the cavity 109 until it is transmitted through the output port, e.g., output window 108 when mounted over light source sub-assembly 115. Bottom reflector insert 106 may optionally be placed over mounting board 104. Bottom reflector insert 106 includes holes such that the light emitting portion of each LED 102 is not blocked by bottom reflector insert 106. Sidewall insert 107 may optionally be placed inside cavity body 105 such that the interior surfaces of sidewall insert 107 direct light from the LEDs 102 to the output window when cavity body 105 is mounted over light source sub-assembly 115. Although as depicted, the interior sidewalls of cavity body 105 are rectangular in shape as viewed from the top of illumination module 100, other shapes may be contemplated (e.g., clover shaped or polygonal). In addition, the interior sidewalls of cavity body 105 may taper outward from mounting board 104 to output window 108, rather than perpendicular to output window 108 as depicted.

Figure 4A:
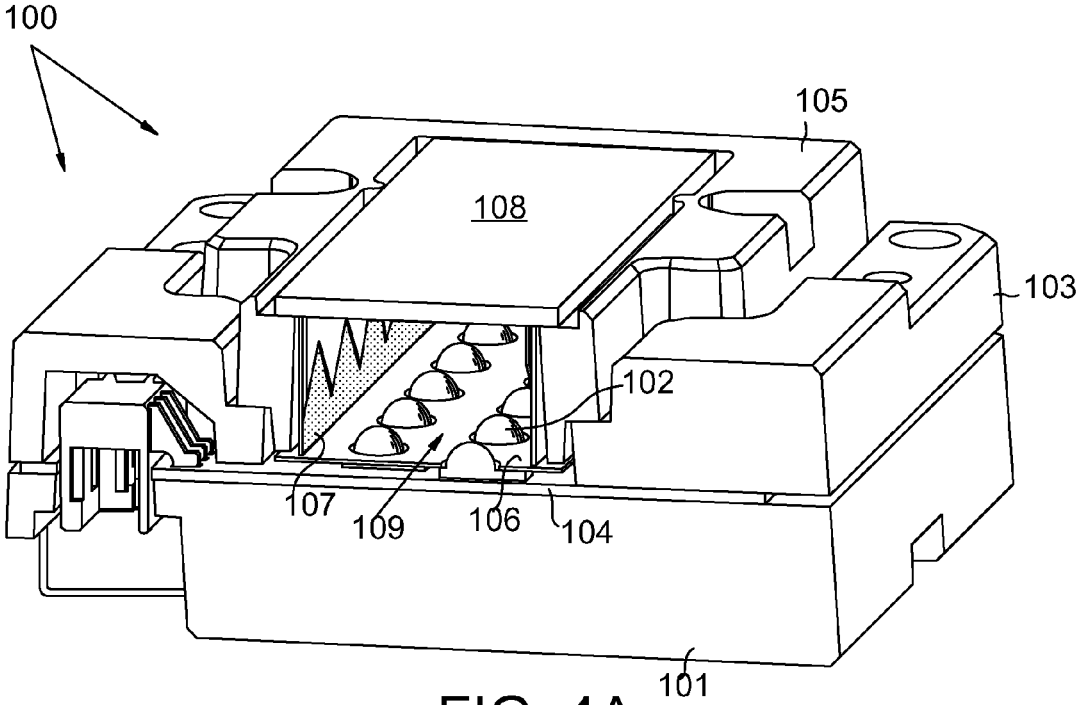
FIGS. 4A and 4B illustrates a perspective, cross-sectional view of LED based illumination device as depicted in FIG. 1.
Figure 4B:
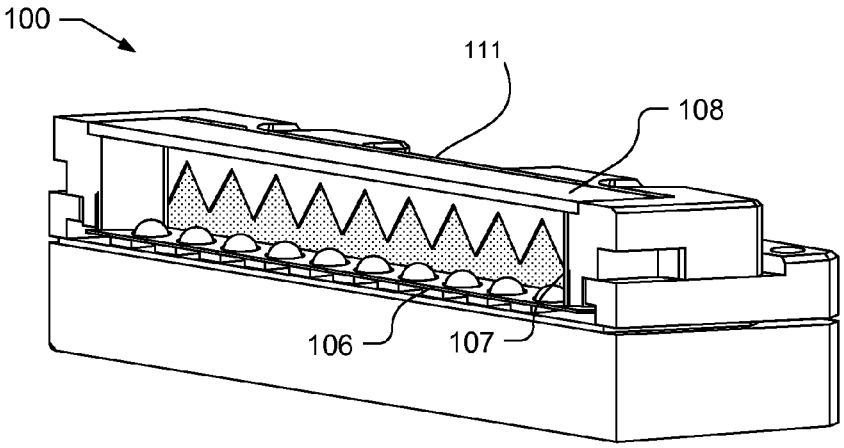

FIGS. 4A and 4B illustrate perspective, cross-sectional views of LED based illumination module 100 as depicted in FIG. 1. In this embodiment, the sidewall insert 107, output window 108, and bottom reflector insert 106 disposed on mounting board 104 define a light mixing cavity 109 (illustrated in FIG. 4A) in the LED based illumination module 100 in which a portion of light from the LEDs 102 is reflected until it exits through output window 108. Reflecting the light within the cavity 109 prior to exiting the output window 108 has the effect of mixing the light and providing a more uniform distribution of the light that is emitted from the LED based illumination module 100.

In some embodiments, any of the bottom reflector insert 106, sidewall insert 107, and cavity body 105 may include a polytetrafluoroethylene (PTFE) material. In one example, any of the bottom reflector insert 106, sidewall insert 107, and cavity body 105 may be made from a PTFE material. In another example, any of the bottom reflector insert 106, sidewall insert 107, and cavity body 105 may include a PTFE layer backed by a reflective layer such as a polished metallic layer. The PTFE material may be formed from sintered PTFE particles. The PTFE material is less reflective than other materials that may be used for the bottom reflector insert 106, sidewall insert 107 or cavity body 105, such as Miro® produced by Alanod. In one example, the blue light output of an illumination module 100 constructed with uncoated, i.e., no phosphor coating, Miro® sidewall insert 107 was compared to the same module constructed with an uncoated PTFE sidewall insert 107 constructed from sintered PTFE material manufactured by Berghof (Germany). Blue light output from module 100 was decreased 7% by use of a PTFE sidewall insert. Similarly, blue light output from module 100 was decreased 5% compared to uncoated Miro® sidewall insert 107 by use of a PTFE sidewall insert 107 constructed from sintered PTFE material manufactured by W.L. Gore (USA). Light extraction from the module 100 is directly related to the reflectivity inside the cavity 109, and thus, the inferior reflectivity of the PTFE material, compared to other available reflective materials, would lead away from using the PTFE material in the cavity 109. Nevertheless, the inventors have determined that when the PTFE material is coated with phosphor, the PTFE material unexpectedly produces an increase in luminous output compared to other more reflective materials, such as Miro®, with a similar phosphor coating. In another example, the white light output of an illumination module 100 targeting a correlated color temperature (CCT) of 4,000 Kelvin constructed with phosphor coated Miro® sidewall insert 107 was compared to the same module constructed with a phosphor coated PTFE sidewall insert 107 constructed from sintered PTFE material manufactured by Berghof (Germany). White light output from module 100 was increased 7% by use of a phosphor coated PTFE sidewall insert compared to phosphor coated Miro®. Similarly, white light output from module 100 was increased 14% compared to phosphor coated Miro® sidewall insert 107 by use of a PTFE sidewall insert 107 constructed from sintered PTFE material manufactured by W.L. Gore (USA). In another example, the white light output of an illumination module 100 targeting a correlated color temperature (CCT) of 3,000 Kelvin constructed with phosphor coated Miro® sidewall insert 107 was compared to the same module constructed with a phosphor coated PTFE sidewall insert 107 constructed from sintered PTFE material manufactured by Berghof (Germany). White light output from module 100 was increased 10% by use of a phosphor coated PTFE sidewall insert compared to phosphor coated Miro®. Similarly, white light output from module 100 was increased 12% compared to phosphor coated Miro® sidewall insert 107 by use of a PTFE sidewall insert 107 constructed from sintered PTFE material manufactured by W.L. Gore (USA). Thus, it has been discovered that, despite being less reflective, it is desirable to construct phosphor covered portions of the light mixing cavity 109 from a PTFE material. Moreover, the inventors have also discovered that phosphor coated PTFE material has greater durability when exposed to the heat from LEDs, e.g., in a light mixing cavity 109, compared to other more reflective materials, such as Miro®, with a similar phosphor coating.

In one embodiment, sidewall insert 107 is coated with a phosphor material. In this example, a 7-15% increase in luminous output from illumination module 100 may be obtained by replacing a phosphor coated specular reflective sidewall insert 107 constructed of Miro®, manufactured by Alanod (Germany) with a phosphor coated sintered PTFE material manufactured by Berghof (Germany). This is counterintuitive because the reflectivity of the sintered PTFE material is lower than the reflectivity of the Alanod material. In this case, the reflectivity of the specular reflective sidewall insert 107 is approximately 98%, but the reflectivity of the sintered PTFE sidewall insert of one millimeter thickness is approximately 80%. Although the PTFE material exhibits lower reflectivity, when coated with a phosphor material in a light mixing cavity, the inventors have determined that the efficiency of color conversion and light output of the light mixing cavity is unpredictably increased.

Portions of cavity 109, such as the bottom reflector insert 106, sidewall insert 107, and cavity body 105, may be coated with a wavelength converting material. FIG. 4B illustrates portions of the sidewall insert 107 coated with a wavelength converting material. Furthermore, portions of output window 108 may be coated with the same or a different wavelength converting material. In addition, portions of bottom reflector insert 106 may be coated with the same or a different wavelength converting material. The photo converting properties of these materials in combination with the mixing of light within cavity 109 results in a color converted light output by output window 108. By tuning the chemical properties of the wavelength converting materials and the geometric properties of the coatings on the interior surfaces of cavity 109, specific color properties of light output by output window 108 may be specified, e.g., color point, color temperature, and color rendering index (CRI). Any of the bottom reflector insert 106, cavity body 105, and sidewall insert 107 may be constructed from or include a PTFE material at an interior surface facing light mixing cavity 109. In one example, any of the interior surfaces of any of the bottom reflector insert 106, cavity body 105, and sidewall insert 107 constructed from a PTFE material may be coated with a wavelength converting material. In other examples, a wavelength converting material may be mixed with the PTFE material. For purposes of this patent document, a wavelength converting material is any single chemical compound or mixture of different chemical compounds that performs a color conversion function, e.g., absorbs light of one peak wavelength and emits light at another peak wavelength.

Cavity 109 may be filled with a non-solid material, such as air or an inert gas, so that the LEDs 102 emit light into the non-solid material. By way of example, the cavity may be hermetically sealed and Argon gas used to fill the cavity. Alternatively, Nitrogen may be used. In other embodiments, cavity 109 may be filled with a solid encapsulant material. By way of example, silicone may be used to fill the cavity.

The LEDs 102 can emit different or the same colors, either by direct emission or by phosphor conversion, e.g., where phosphor layers are applied to the LEDs as part of the LED package. Thus, the illumination module 100 may use any combination of colored LEDs 102, such as red, green, blue, amber, or cyan, or the LEDs 102 may all produce the same color light or some or all may produce white light. For example, the LEDs 102 may all emit either blue or UV light. When used in combination with phosphors (or other wavelength conversion means), which may be, e.g., in or on the output window 108, applied to the sidewalls of cavity body 105, or applied to other components placed inside the cavity (not shown), such that the output light of the illumination device 100 has the color as desired. The phosphors may be chosen from the set denoted by the following chemical formulas: $Y_3Al_5O_{12}$:Ce, (also known as YAG: Ce, or simply YAG) $(Y,Gd)_3Al_5O_{12}$:Ce, CaS:Eu, SrS:Eu, $SrGa_2S4$:Eu, $Ca_3(Sc, Mg)_2Si_3O_{12}$: Ce, $Ca_3SC_2Si_3O_{12}$: Ce, $Ca_3SC_2O_4$: Ce, $Ba_3Si_6O_{12}N_2$:Eu, $(Sr,Ca)AlSiN_3$:Eu, $CaAlSiN_3$:Eu. The adjustment of color point of the illumination device may be accomplished by replacing sidewall insert 107 and/or the output window 108, which similarly may be coated or impregnated with one or more wavelength converting materials.

In one embodiment a red emitting phosphor such as $CaAlSiN_3$:Eu, or $(Sr,Ca)AlSiN_3$:Eu covers a portion of sidewall insert 107 and bottom reflector insert 106 at the bottom of the cavity 109, and a YAG phosphor covers a portion of the output window 108. By choosing the shape and height of the sidewalls that define the cavity, and selecting which of the parts in the cavity will be covered with phosphor or not, and by optimization of the layer thickness of the phosphor layer on the window, the color point of the light emitted from the module can be tuned as desired.

In one example, a single type of wavelength converting material may be patterned on the sidewall, which may be, e.g., the sidewall insert 107 shown in FIG. 4B. By way of example, a red phosphor may be patterned on different areas of the sidewall insert 107 and a yellow phosphor may cover the output window 108, shown in FIG. 9A. The coverage and/or concentrations of the phosphors may be varied to produce different color temperatures. It should be understood that the coverage area of the red and/or the concentrations of the red and yellow phosphors will need to vary to produce the desired color temperatures if the blue light produced by the LEDs 102 varies. The color performance of the LEDs 102, red phosphor on the sidewall insert 107 and the yellow phosphor on the output window 108 may be measured before assembly and selected based on performance so that the assembled pieces produce the desired color temperature. In one example, the thickness of the red phosphor may be, e.g., between 60 μm to 100 μm and more specifically between 80 μm to 90 μm, while the thickness of the yellow phosphor may be, e.g., between 100 μm to 140 μm and more specifically between 110 μm to 120 μm. The red phosphor may be mixed with a binder at a concentration of 1%-3% by volume. The yellow phosphor may be mixed with a binder at a concentration of 12%-17% by volume.

Figure 5:
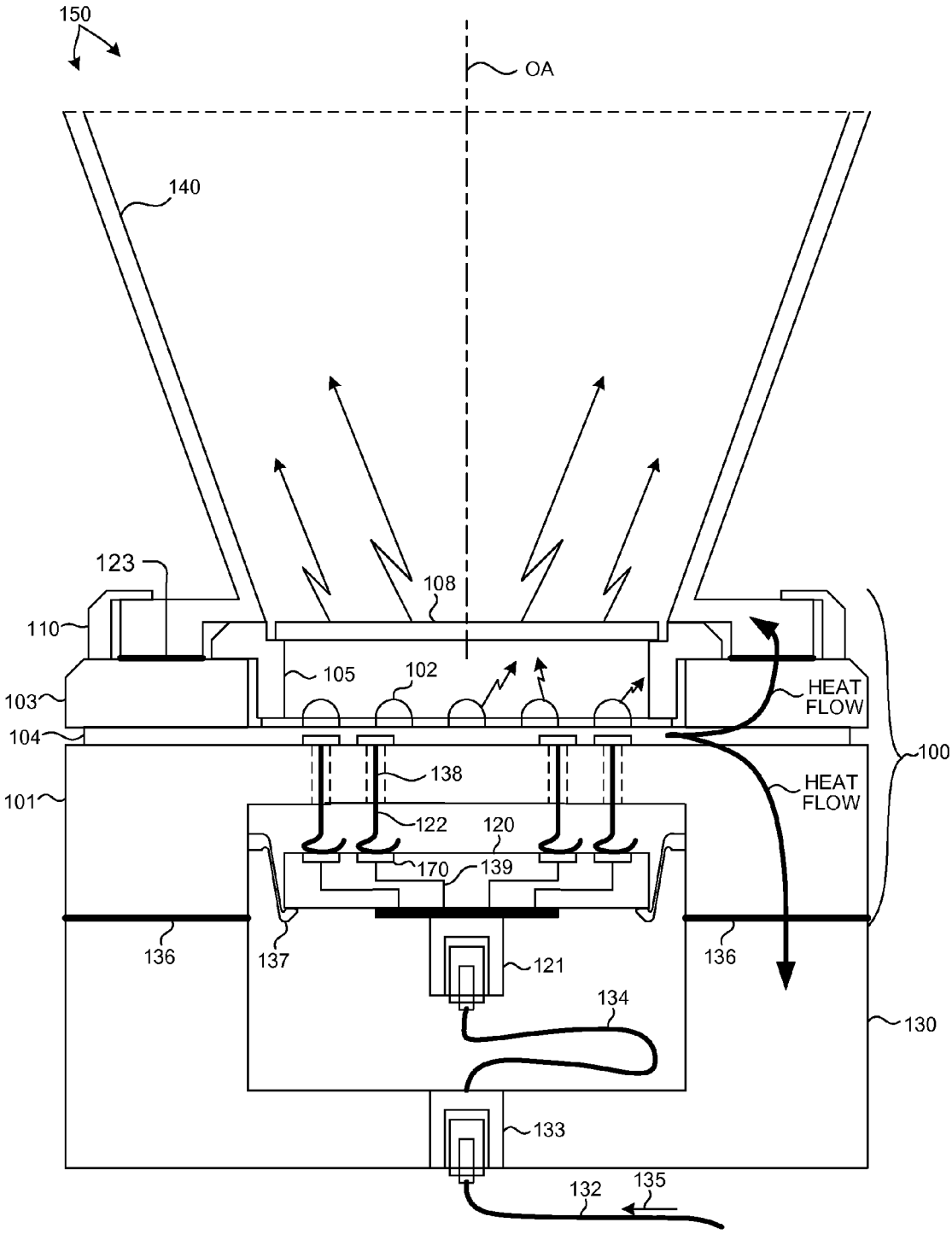
FIG. 5 illustrates a cut-away view of luminaire as depicted in FIG. 2.

FIG. 5 illustrates a cut-away view of luminaire 150 as depicted in FIG. 2. Reflector 140 is removably coupled to illumination module 100. Reflector 140 is coupled to module 100 by a twist-lock mechanism. Reflector 140 is aligned with module 100 by bringing reflector 140 into contact with module 100 through openings in reflector retaining ring 110. Reflector 140 is coupled to module 100 by rotating reflector 140 about optical axis (OA) to an engaged position. In the engaged position, the reflector 140 is captured between mounting board retaining ring 103 and reflector retaining ring 110. In the engaged position, an interface pressure may be generated between mating thermal interface surface 123 of reflector 140 and mounting board retaining ring 103. In this manner, heat generated by LEDs 102 may be conducted via mounting board 104, through mounting board retaining ring 103, through interface 123, and into reflector 140. In addition, a plurality of electrical connections may be formed between reflector 140 and retaining ring 103.

Illumination module 100 includes an electrical interface module (EIM) 120. As illustrated, EIM 120 may be removably attached to illumination module 100 by retaining clips 137. In other embodiments, EIM 120 may be removably attached to illumination module 100 by an electrical connector coupling EIM 120 to mounting board 104. EIM 120 may also be coupled to illumination module 100 by other fastening means, e.g., screw fasteners, rivets, or snap-fit connectors. As depicted EIM 120 is positioned within a cavity of illumination module 100. In this manner, EIM 120 is contained within illumination module 100 and is accessible from the bottom side of illumination module 100. In other embodiments, EIM 120 may be at least partially positioned within light fixture 130. The EIM 120 communicates electrical signals from light fixture 130 to illumination module 100. Electrical conductors 132 are coupled to light fixture 130 at electrical connector 133. By way of example, electrical connector 133 may be a registered jack (RJ) connector commonly used in network communications applications. In other examples, electrical conductors 132 may be coupled to light fixture 130 by screws or clamps. In other examples, electrical conductors 132 may be coupled to light fixture 130 by a removable slip-fit electrical connector. Connector 133 is coupled to conductors 134. Conductors 134 are removably coupled to electrical connector 121 that is mounted to EIM 120. Similarly, electrical connector 121 may be a RJ connector or any suitable removable electrical connector. Connector 121 is fixedly coupled to EIM 120. Electrical signals 135 are communicated over conductors 132 through electrical connector 133, over conductors 134, through electrical connector 121 to EIM 120. Electrical signals 135 may include power signals and data signals. EIM 120 routes electrical signals 135 from electrical connector 121 to appropriate electrical contact pads on EIM 120. For example, conductor 139 within EIM 120 may couple connector 121 to electrical contact pad 170 on the top surface of EIM 120. As illustrated, spring pin 122 removably couples electrical contact pad 170 to mounting board 104. Spring pins couple contact pads disposed on the top surface of EIM 120 to contact pads of mounting board 104. In this manner, electrical signals are communicated from EIM 120 to mounting board 104. Mounting board 104 includes conductors to appropriately couple LEDs 102 to the contact pads of mounting board 104. In this manner, electrical signals are communicated from mounting board 104 to appropriate LEDs 102 to generate light. EIM 120 may be constructed from a printed circuit board (PCB), a metal core PCB, a ceramic substrate, or a semiconductor substrate. Other types of boards may be used, such as those made of alumina (aluminum oxide in ceramic form), or aluminum nitride (also in ceramic form). EIM 120 may be a constructed as a plastic part including a plurality of insert molded metal conductors.

Mounting base 101 is replaceably coupled to light fixture 130. In the illustrated example, light fixture 130 acts as a heat sink. Mounting base 101 and light fixture 130 are coupled together at a thermal interface 136. At the thermal interface 136, a portion of mounting base 101 and a portion of light fixture 130 are brought into contact as illumination module 100 is coupled to light fixture 130. In this manner, heat generated by LEDs 102 may be conducted via mounting board 104, through mounting base 101, through interface 136, and into light fixture 130.

To remove and replace illumination module 100, illumination module 100 is decoupled from light fixture 130 and electrical connector 121 is disconnected. In one example, conductors 134 includes sufficient length to allow sufficient separation between illumination module 100 and light fixture 130 to allow an operator to reach between fixture 130 and module 100 to disconnect connector 121. In another example, connector 121 may be arranged such that a displacement between illumination module 100 from light fixture 130 operates to disconnect connector 121. In another example, conductors 134 are wound around a spring-loaded reel. In this manner, conductors 134 may be extended by unwinding from the reel to allow for connection or disconnection of connector 121, and then conductors 134 may be retracted by winding conductors 134 onto the reel by action of the spring-loaded reel.

Figure 6:
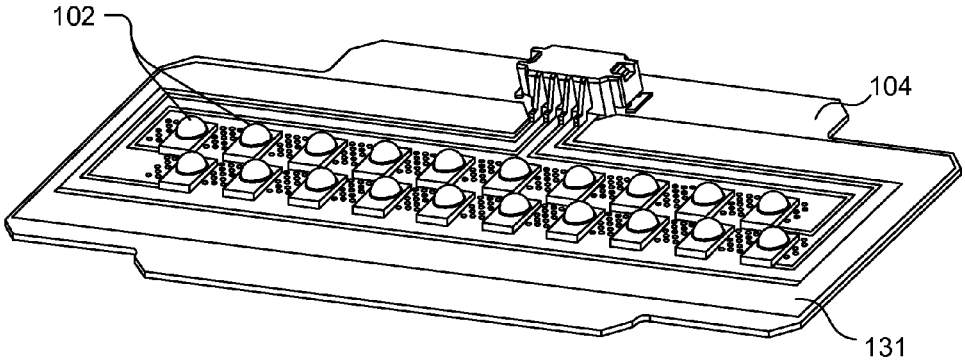
FIG. 6 illustrates a mounting board that provides electrical connections to the attached LEDs and a heat spreading layer for the LED illumination device.

FIG. 6 illustrates mounting board 104 in greater detail. The mounting board 104 provides electrical connections to the attached LEDs 102 to a power supply (not shown). In one embodiment, the LEDs 102 are packaged LEDs, such as the Luxeon Rebel manufactured by Philips Lumileds Lighting. Other types of packaged LEDs may also be used, such as those manufactured by OSRAM (Oslon package), Luminus Devices (USA), Cree (USA), Nichia (Japan), or Tridonic (Austria). As defined herein, a packaged LED is an assembly of one or more LED die that contains electrical connections, such as wire bond connections or stud bumps, and possibly includes an optical element and thermal, mechanical, and electrical interfaces. The LEDs 102 may include a lens over the LED chips. Alternatively, LEDs without a lens may be used. LEDs without lenses may include protective layers, which may include phosphors. The phosphors can be applied as a dispersion in a binder, or applied as a separate plate. Each LED 102 includes at least one LED chip or die, which may be mounted on a submount. The LED chip typically has a size about 1 mm by 1 mm by 0.5 mm, but these dimensions may vary. In some embodiments, the LEDs 102 may include multiple chips. The multiple chips can emit light of similar or different colors, e.g., red, green, and blue. In addition, different phosphor layers may be applied on different chips on the same submount. The submount may be ceramic or other appropriate material. The submount typically includes electrical contact pads on a bottom surface that are coupled to contacts on the mounting board 104. Alternatively, electrical bond wires may be used to electrically connect the chips to a mounting board. Along with electrical contact pads, the LEDs 102 may include thermal contact areas on the bottom surface of the submount through which heat generated by the LED chips can be extracted. The thermal contact areas of the LEDs are coupled to heat spreading layers 131 on the mounting board 104. Heat spreading layers 131 may be disposed on any of the top, bottom, or intermediate layers of mounting board 104. Heat spreading layers 131 may be connected by vias that connect any of the top, bottom, and intermediate heat spreading layers.

In some embodiments, the mounting board 104 conducts heat generated by the LEDs 102 to the sides of the board 104 and the bottom of the board 104. In one example, the bottom of mounting board 104 may be thermally coupled to a heat sink 130 (shown in FIG. 9) via mounting base 101. In other examples, mounting board 104 may be directly coupled to a heat sink, or a lighting fixture and/or other mechanisms to dissipate the heat, such as a fan. In some embodiments, the mounting board 104 conducts heat to a heat sink thermally coupled to the top of the board 104. For example, mounting board retaining ring 103 and cavity body 105 may conduct heat away from the top surface of mounting board 104. Mounting board 104 may be an FR4 board, e.g., that is 0.5 mm thick, with relatively thick copper layers, e.g., 30 μm to 100 μm, on the top and bottom surfaces that serve as thermal contact areas. In other examples, the board 104 may be a metal core printed circuit board (PCB) or a ceramic submount with appropriate electrical connections. Other types of boards may be used, such as those made of alumina (aluminum oxide in ceramic form), or aluminum nitride (also in ceramic form).

Mounting board 104 includes electrical pads to which the electrical pads on the LEDs 102 are connected. The electrical pads are electrically connected by a metal, e.g., copper, trace to a contact, to which a wire, bridge or other external electrical source is connected. In some embodiments, the electrical pads may be vias through the board 104 and the electrical connection is made on the opposite side, i.e., the bottom, of the board. Mounting board 104, as illustrated, is rectangular in dimension. LEDs 102 mounted to mounting board 104 may be arranged in different configurations on rectangular mounting board 104. In one example LEDs 102 are aligned in rows extending in the length dimension and in columns extending in the width dimension of mounting board 104. In another example, LEDs 102 are arranged in a hexagonally closely packed structure. In such an arrangement each LED is equidistant from each of its immediate neighbors. Such an arrangement is desirable to increase the uniformity of light emitted from the light source sub-assembly 115.

Figure 7A:
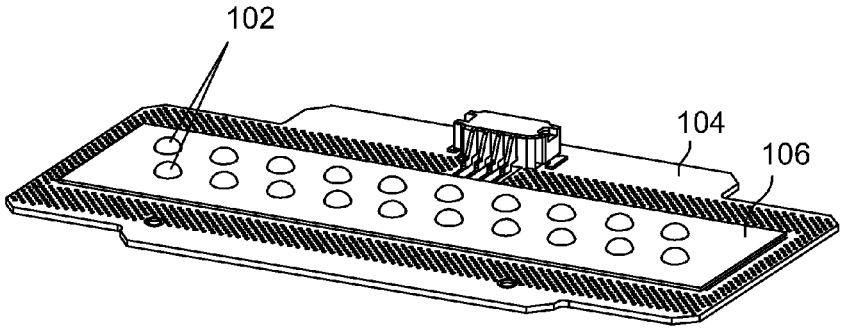
FIG. 7A illustrates a bottom reflector insert attached to the top surface of the mounting board.

FIG. 7A illustrates a bottom reflector insert 106 attached to the top surface of the mounting board 104. The bottom reflector insert 106 may be made from a material with high thermal conductivity and may be placed in thermal contact with the board 104. As illustrated, the bottom reflector insert 106 may be mounted on the top surface of the board 104, around the LEDs 102. The bottom reflector insert 106 may be highly reflective so that light reflecting downward in the cavity 109 is reflected back generally towards the output window 108. Additionally, the bottom reflector insert 106 may have a high thermal conductivity, such that it acts as an additional heat spreader.

Figure 7B:
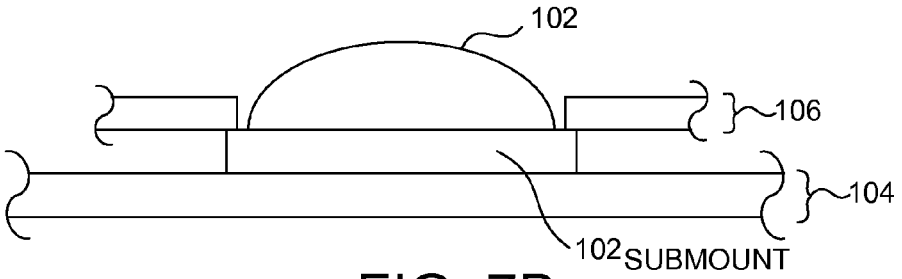
FIG. 7B illustrates a cross-sectional view of a portion of the mounting board, a bottom reflector insert and an LED with a submount, where the thickness of the bottom reflector insert is approximately the same thickness as the submount of the LED.
Figure 7C:
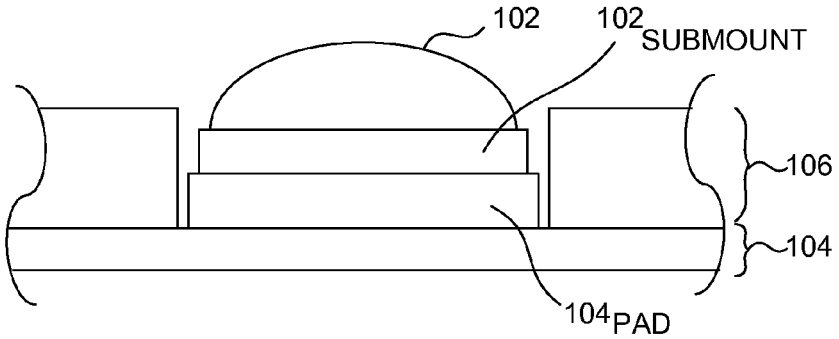
FIG. 7C illustrates another cross-sectional view of a portion of the mounting board, a bottom reflector insert and an LED with a submount, where the thickness of bottom reflector insert is significantly greater than the thickness of the submount of the LED.
Figure 7D:
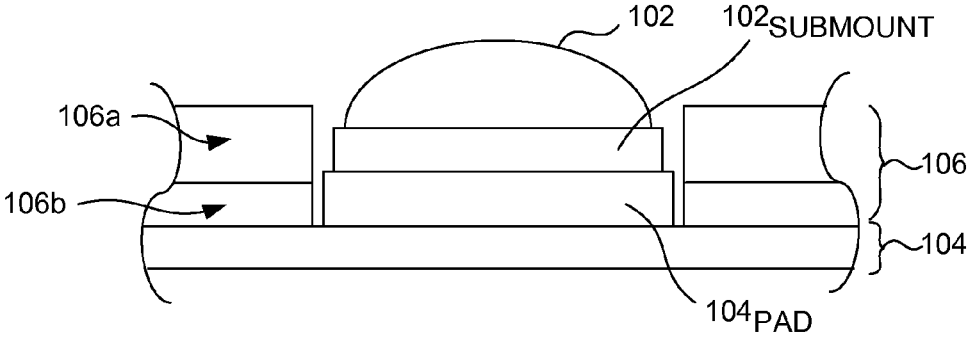
FIG. 7D illustrates another cross-sectional view of a portion of the mounting board, a bottom reflector insert and an LED with a submount, where the bottom reflector insert includes a non-metallic layer and a thin metallic reflective backing layer.

As illustrated in FIG. 7B, the thickness of the bottom reflector insert 106 may be approximately the same thickness as the submounts $\mathbf{102}_{submount}$ of the LEDs 102 or slightly thicker. Holes are punched in the bottom reflector insert 106 for LEDs 102 and bottom reflector insert 106 is mounted over the LED package submounts $\mathbf{102}_{submount}$, and the rest of the board 104. In this manner a highly reflective surface covers the bottom of cavity 109 except in the areas where light is emitted by LEDs 102. By way of example, the bottom reflector insert 106 may be made with a highly thermally conductive material, such as an aluminum based material that is processed to make the material highly reflective and durable. By way of example, a material referred to as Miro®, manufactured by Alanod, a German company, may be used as the bottom reflector insert 106. The high reflectivity of the bottom reflector insert 106 may either be achieved by polishing the aluminum, or by covering the inside surface of the bottom reflector insert 106 with one or more reflective coatings. The bottom reflector insert 106 might alternatively be made from a highly reflective thin material, such as Vikuiti™ ESR, as sold by 3M (USA), which has a thickness of 65 μm. In other examples, bottom reflector insert 106 may be made from a highly reflective non-metallic material such as Lumirror™ E60L manufactured by Toray (Japan) or microcrystalline polyethylene terephthalate (MCPET) such as that manufactured by Furukawa Electric Co. Ltd. (Japan). In other examples, bottom reflector insert 106 may be made from a PTFE material. In some examples bottom reflector insert 106 may be made from a PTFE material of one to two millimeters thick, as sold by W.L. Gore (USA) and Berghof (Germany). In yet other embodiments, bottom reflector insert 106 may be constructed from a PTFE material backed by a thin reflective layer such as a metallic layer or a non-metallic layer such as ESR, E60L, or MCPET. The thickness of bottom reflector insert 106, particularly when constructed from a non-metallic reflective film, may be significantly greater than the thickness of the submounts $\mathbf{102}_{submount}$ of LEDs 102 as illustrated in FIG. 7C. To accommodate for the increased thickness without impinging on light emitted from LEDs 102, holes may be punched in the bottom reflector insert 106 to reveal the submount $\mathbf{102}_{submount}$ of the LED package, and bottom reflector insert 106 is mounted directly on top of mounting board 104. In this manner, the thickness of bottom reflector insert 106 may be greater than the thickness of the submount $\mathbf{102}_{submount}$ without significantly impinging on light emitted by LEDs 102. This solution is particularly attractive when LED packages with submounts that are only slightly larger than the light emitting portion of the LED are employed. In other examples, mounting board 104 may include raised pads $\mathbf{104}_{pad}$ to approximately match the footprint of the LED submount $\mathbf{102}_{submount}$ such that the light emitting portion of LED 102 is raised above bottom reflector insert 106. In some examples, the non-metallic layer 106*a* may be backed by a thin metallic reflective backing layer 106*b* to enhance overall reflectivity as illustrated in FIG. 7D. For example, the non-metallic reflective layer 106*a* may exhibit diffuse reflective properties and the reflective backing layer 106*b* may exhibit specular reflective properties. This approach has been effective in reducing the potential for wave-guiding inside specular reflective layers. It is desirable to minimize wave-guiding within reflective layers because wave-guiding reduces overall cavity efficiency.

The cavity 109 and the bottom reflector insert 106 may be thermally coupled and may be produced as one piece if desired. The bottom reflector insert 106 may be mounted to the board 104, e.g., using a thermal conductive paste or tape. In one example, cavity body 105 and bottom reflector insert 106 may be molded together as one part from a PTFE material. In another embodiment, the top surface of the mounting board 104 is configured to be highly reflective, so as to obviate the need for the bottom reflector insert 106. Alternatively, a reflective coating might be applied to board 104, the coating composed of white particles e.g. made from TiO2, ZnO, PTFE particles, or BaSO4 immersed in a transparent binder such as an epoxy, silicone, acrylic, or N-Methylpyrrolidone (NMP) materials. In another embodiment the PTFE particles may be sintered without the use of a binder. Alternatively, the coating might be made from a phosphor material such as YAG:Ce. The coating of phosphor material and/or the TiO2, ZnO or GaSO4 material may be applied directly to the board 104 or to, e.g., the bottom reflector insert 106, for example, by screen printing.

Figure 7E:
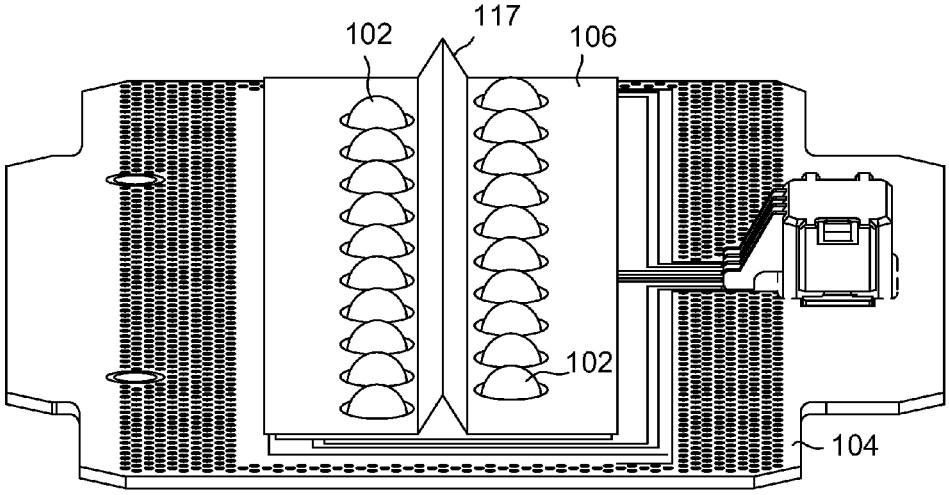
FIG. 7E illustrates a perspective view of another embodiment of the mounting board and bottom reflector insert that includes a raised portion between the LEDs.

FIG. 7E illustrates a perspective view of another embodiment of illumination device 100. If desired, e.g., where a large number of LEDs 102 are used, the bottom reflector insert 106 may include a raised portion between the LEDs 102 such as that illustrated in FIG. 7D. Illumination device 100 is illustrated in FIG. 7E with a diverter 117 between the LEDs configured to redirect light emitted at large angles from the LEDs 102 into narrower angles with respect to a normal to the top surface of mounting board 104. In this manner, light emitted by LEDs 102 that is close to parallel to the top surface of mounting board 104 is redirected upwards toward the output window 108 so that the light emitted by the illumination device has a smaller cone angle compared to the cone angle of the light emitted by the LEDs directly. The use of a bottom reflector insert 106 with a diverter 117 is useful when LEDs 102 are selected that emit light over large output angles, such as LEDs that approximate a Lambertian source. By reflecting the light into narrower angles, the illumination device 100 can be used in applications where light under large angles is to be avoided, for example, due to glare issues (office lighting, general lighting) or due to efficiency reasons where it is desirable to send light only where it is needed and most effective, e.g. task lighting and under cabinet lighting. Moreover, the efficiency of light extraction is improved for the illumination device 100 as light emitted in large angles undergoes fewer reflections in cavity 109 before reaching the output window 108 compared to a device without the bottom reflector insert 106. This is particularly advantageous when used in combination with a light tunnel or integrator, as it is beneficial to limit the flux in large angles due to efficiency losses incurred by repeated reflections in the mixing cavity. The diverter 117 is illustrated as having a tapered shape, but alternative shapes may be used if desired, for example, a half dome shape, or a spherical cap, or aspherical reflector shapes. The diverter 117 can have a specular reflective coating, a diffuse coating, or can be coated with one or more phosphors. In other examples, diverter 117 can be constructed from a PTFE material. Diverter 117 constructed from a PTFE material may be coated or impregnated with one or more phosphors. The height of the diverter 117 may be smaller than the height of the cavity 109 (e.g., approximately half the height of the cavity 109) so that there is a small space between the top of the diverter 117, and the output window 108. There may be multiple diverters implemented in cavity 109.

Figure 7F:
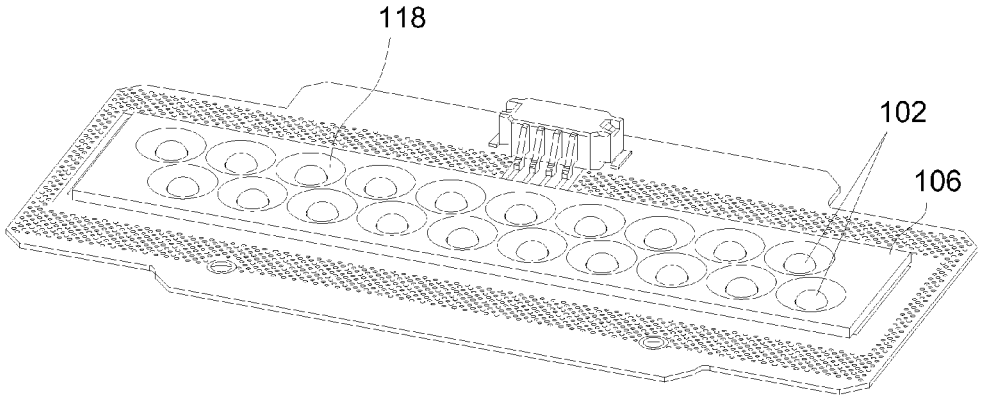
FIG. 7F illustrates another embodiment of a bottom reflector insert where each LED is surrounded by a separate individual optical well.

FIG. 7F illustrates another embodiment of a bottom reflector insert 106 where each LED 102 in illumination device 100 is surrounded by a separate individual optical well 118. Optical well 118 may have a parabolic, compound parabolic, elliptical shape, or other appropriate shape. The light from illumination device 100 is collimated from large angles into smaller angles, e.g., from a 2×90 degree angle to a 2×60 degree angle, or a 2×45 degree beam. The illumination device 100 can be used as a direct light source, for example, as a down light or an under the cabinet light, or it can be used to inject the light into a cavity 109. The optical well 118 can have a specular reflective coating, a diffuse coating, or can be coated with one or more phosphors. Optical well 118 may be constructed as part of bottom reflector insert 106 in one piece of material or may be constructed separately and combined with bottom reflector insert 106 to form a bottom reflector insert 106 with optical well features. In other examples, optical well 118 can be constructed from a PTFE material. Optical well 118 constructed from a PTFE material may be coated or impregnated with one or more phosphors.

Figure 8A:
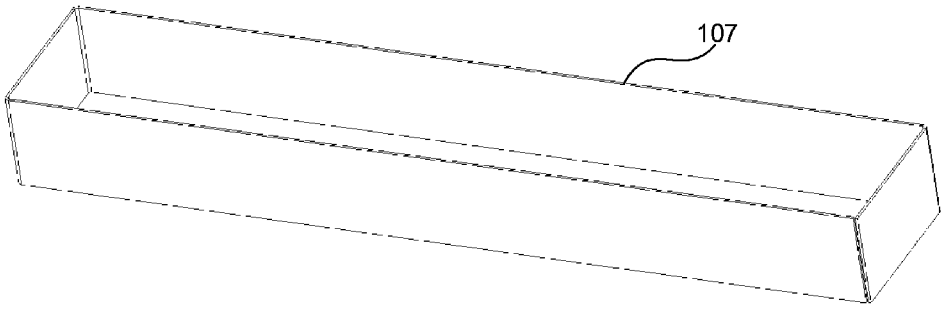
FIG. 8A illustrates an embodiment of sidewall insert used with the illumination device.

FIG. 8A illustrates sidewall insert 107. Sidewall insert 107 may be made with highly thermally conductive material, such as an aluminum based material that is processed to make the material highly reflective and durable. By way of example, a material referred to as Miro®, manufactured by Alanod, a German company, may be used. The high reflectivity of sidewall insert 107 may be achieved by polishing the aluminum, or by covering the inside surface of the sidewall insert 107 with one or more reflective coatings. The sidewall insert 107 might alternatively be made from a highly reflective thin material, such as Vikuiti™ ESR, as sold by 3M (USA), which has a thickness of 65 μm. In other examples, sidewall insert 107 may be made from a highly reflective non-metallic material such as Lumirror™ E60L manufactured by Toray (Japan) or microcrystalline polyethylene terephthalate (MCPET) such as that manufactured by Furukawa Electric Co. Ltd. (Japan). The interior surfaces of sidewall insert 107 can either be specular reflective or diffuse reflective. An example of a highly specular reflective coating is a silver mirror, with a transparent layer protecting the silver layer from oxidation. Examples of highly diffuse reflective materials include MCPET and Toray E60L materials. Also, highly diffuse reflective coatings can be applied. Such coatings may include titanium dioxide (TiO2), zinc oxide (ZnO), and barium sulfate (BaSO4) particles, or a combination of these materials. In other examples, sidewall insert 107 may be made from a PTFE material. In some examples sidewall insert 107 may be made from a PTFE material of one to two millimeters thick, as sold by W.L. Gore (USA) and Berghof (Germany). In yet other embodiments, sidewall insert 107 may be constructed from a PTFE material backed by a thin reflective layer such as a metallic layer or a non-metallic layer such as ESR, E60L, or MCPET. A non-metallic reflective layer may be backed by a reflective backing layer to enhance overall reflectivity. For example, the non-metallic reflective layer may exhibit diffuse reflective properties and the reflective backing layer may exhibit specular reflective properties. This approach has been effective in reducing the potential for wave-guiding inside specular reflective layers; resulting in increased cavity efficiency.

In one embodiment, sidewall insert 107 may be made of a highly diffuse, reflective PTFE material. A portion of the interior surfaces may be coated with an overcoat layer or impregnated with a wavelength converting material, such as phosphor or luminescent dyes. Such a wavelength converting material will be generally referred to herein as phosphor for the sake of simplicity, although any photoluminescent material, or combination of photoluminescent materials, is considered a wavelength converting material for purposes of this patent document. By way of example, a phosphor that may be used may include $Y_2Al_5O_{12}$:Ce, $(Y,Gd)_3Al_5O_{22}$:Ce, CaS:Eu, SrS:Eu, $SrGa_2S4$:Eu, $Ca_2(Sc,Mg)_2Si_2O_{22}$:Ce, $Ca_2Sc_2Si_2O_{22}$:Ce, $Ca_2Sc_2O_4$:Ce, $Ba_2Si_6O_{22}N_2$:Eu, (Sr,Ca) $AlSiN_2$:Eu, $CaAlSiN_2$:Eu. The coating may contain either or both diffusing particles and particles with wavelength converting properties such as phosphors. The coating can be applied to the window 108 by screen printing, blade coating, spray painting, or powder coating. For screen printing, blade coating, and spray painting, typically the particles are immersed in a binder, which can by a polyurethane based lacquer, or a silicone material. The thickness and optical properties of the coating applied to any of sidewall insert 107 and cavity body 105 may be monitored during processing for example by using a laser and a spectrometer, and/or detector, or and/or camera, both in forward scatter and back scatter modes, to obtain the desired color and/or optical properties.

As discussed above, the interior, sidewall surfaces of cavity 109 may be realized using a separate sidewall insert 107 that is placed inside cavity body 105, or may be achieved by treatment of the interior surfaces of cavity body 105. Sidewall insert 107 may be positioned within cavity body 105 and used to define the sidewalls of cavity 109. By way of example, sidewall insert 107 can be inserted into cavity body 105 from the top or the bottom depending on which side has a larger opening.

Figure 8B:
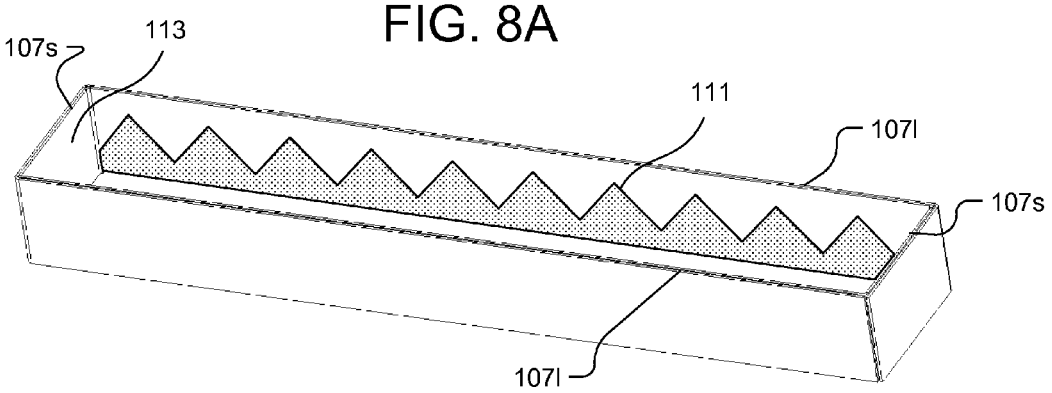
FIGS. 8B and 8C illustrates a perspective view and side view, respectively, of another embodiment of the sidewall insert with a wavelength converting material patterned along the length of the rectangular cavity and no wavelength converting material patterned along the width.
Figure 8C:
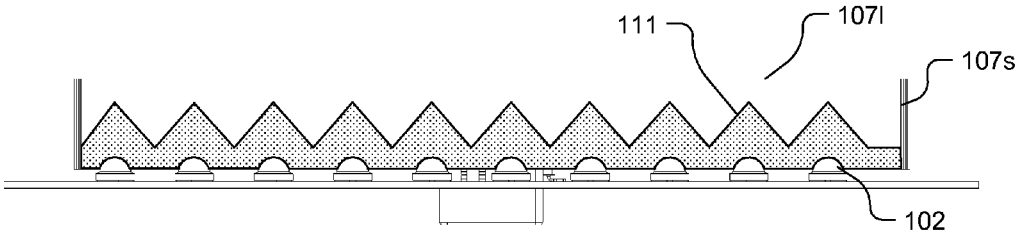

FIGS. 8B and 8C illustrate treatment of selected interior sidewall surfaces of cavity 109. As illustrated in FIGS. 8B and 8C, the described treatments are applied to sidewall insert 107, but as discussed above, sidewall insert 107 may not be used and the described treatments applied to the interior surfaces of cavity 109 directly. FIGS. 8B and 8C illustrate a sawtooth shaped pattern where the peak of each sawtooth is aligned with the placement of each LED as illustrated in FIG. 8C. The implementation of phosphor patterns on the sidewalls corresponding to the length dimension where the phosphor pattern is concentrated around the LEDs has also improved color uniformity and enables more efficient use of phosphor materials. Although, a sawtooth pattern is illustrated, other patterns such as semicircular, parabolic, flattened sawtooth patterns, and others may be employed to similar effect.

Figure 9A:
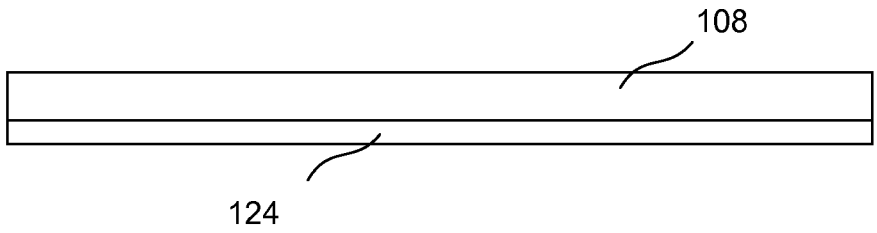
FIG. 9A illustrates a side view of the output window for the illumination device with a layer on the inside surface of the window.
Figure 9B:
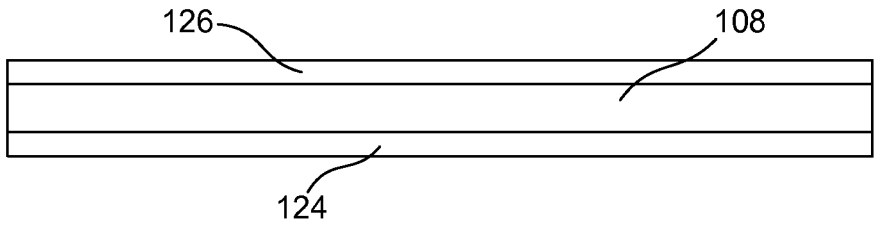
FIG. 9B illustrates a side view of another embodiment of the output window for the illumination device with two additional layers; one on the inside of the window and one on the outside of the window.
Figure 9C:
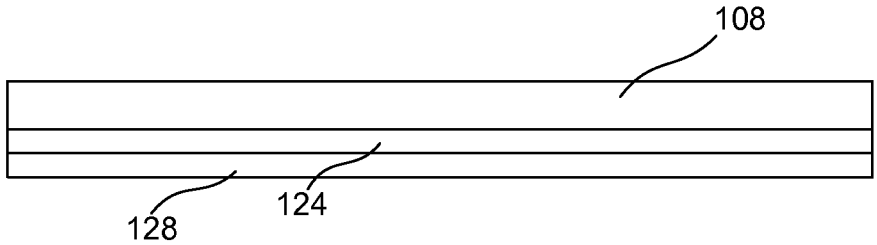
FIG. 9C illustrates a side view of another embodiment of the output window for the illumination device with two additional layers; both on the same inside surface of the window.

FIGS. 9A, 9B, and 9C illustrate various configurations of output window 108 in cross sectional views. In FIGS. 4A and 4B, the window 108 is shown mounted on top of the cavity body 105. It can be beneficial to seal the gap between the window 108 and the cavity body 105 to form a hermetically sealed cavity 109, such that no dust or humidity can enter the cavity 109. A sealing material may be used to fill the gap between the window 108 and the cavity body 105, as for example an epoxy or a silicone material. It may be beneficial to use a material that remains flexible over time due to the differences in thermal expansion coefficients of the materials of the window 108 and cavity body 105. As an alternative, the window 108 might be made of glass or a transparent ceramic material, and soldered onto the cavity body 105. In that case, the window 108 may be plated at the edges with a metallic material, such as aluminum, or silver, or copper, or gold, and solder paste is applied in between the cavity body 105 and window 108. By heating the window 108 and the cavity body 105, the solder will melt and provide a good connection between the cavity body 105 and window 108.

In FIG. 9A, the window 108 has an additional layer 124 on the inside surface of the window, i.e., the surface facing the cavity 109. The additional layer 124 may contain either or both diffusing particles and particles with wavelength converting properties such as phosphors. The layer 124 can be applied to the window 108 by screen printing, spray painting, or powder coating. For screen printing and spray painting, typically the particles are immersed in a binder, which can by a polyurethane based lacquer, or a silicone material. For powder coating a binding material is mixed into the powder mix in the form of small pellets which have a low melting point, and which make a uniform layer when the window 108 is heated, or a base coat is applied to the window 108 to which the particles stick during the coating process. Alternatively, the powder coating may be applied using an electric field, and the window and phosphor particles baked in an oven so that the phosphor permanently adheres to the window. The thickness and optical properties of the layer 124 applied to the window 108 may be monitored during processing for example by using a laser and a spectrometer, and/or detector, or and/or camera, both in forward scatter and back scatter modes, to obtain the desired color and/or optical properties.

In FIG. 9B the window 108 has two additional layers 124 and 126; one on the inside of the window and one on the outside of the window 108, respectively. The outside layer 126 may be white scattering particles, such as TiO2, ZnO, and/or BaSO4 particles. Phosphor particles may be added to the layer 126 to do a final adjustment of the color of the light coming out of the illumination device 100. The inside layer 124 may contain wavelength converting particles, such as a phosphor.

In FIG. 9C the window 108 also has two additional layers 124 and 128, but both are on the same inside surface of the window 108. While two layers are shown, it should be understood that additional layers may be used. In one configuration, layer 124, which is closest to the window 108, includes white scattering particles, such that the window 108 appears white if viewed from the outside, and has a uniform light output over angle, and layer 128 includes a yellow emitting phosphor.

The phosphor conversion process generates heat and thus the window 108 and the phosphor, e.g., in layer 124, on the window 108 should be configured so that they do not get too hot. For this purpose, the window 108 may have a high thermal conductivity, e.g., not less than 1 W/(m K), and the window 108 may be thermally coupled to the cavity body 105, which serves as a heat-sink, using a material with low thermal resistance, such as solder, thermal paste or thermal tape. A good material for the window is aluminum oxide, which can be used in its crystalline form, called Sapphire, as well in its poly-crystalline or ceramic form, called Alumina. Other patterns may be used if desired as for example small dots with varying size, thickness and density. In another embodiment the window might be made from a PFTE material. A phosphor may be coated on or integrated into the window material. The window should be sufficiently thin to permit sufficient light transmission. For example, the PTFE window may be less than one millimeter thick. The PTFE window may include a structural rib to increase the rigidity of the window. In one example, a rib may be positioned on the edge of the window. In another example, the window may be shaped as a cup. In another embodiment, a PFTE layer might be overmolded over a glass or ceramic window.

As illustrated in FIGS. 1 and 2, multiple LEDs 102 may be used in the illumination device 100. The illumination device 100 of FIG. 1 may have more or fewer LEDs, but twenty LEDs has been found to be a useful quantity of LEDs 102. The illumination device 100 of FIG. 2 may have more or fewer LEDs, but ten LEDs has been found to be a useful quantity of LEDs 102. When a large number of LEDs is used, it may be desirable to combine the LEDs into multiple strings, e.g., two strings of ten LEDs, in order to maintain a relatively low forward voltage and current, e.g., no more than 24V and 700 mA. If desired, a larger number of the LEDs may be placed in series, but such a configuration may lead to electrical safety issues.

Any of sidewall insert 107, bottom reflector insert 106, and output window 108 may be patterned with phosphor. Both the pattern itself and the phosphor composition may vary. In one embodiment, the illumination device may include different types of phosphors that are located at different areas of the light mixing cavity 109. For example, a red phosphor may be located on either or both of the sidewall insert 107 and the bottom reflector insert 106 and yellow and green phosphors may be located on the top or bottom surfaces of the window 108 or embedded within the window 108. In one embodiment, a central reflector such as the diverter 117 shown in FIG. 7E may have patterns of different types of phosphor, e.g., a red phosphor on a first area and a green phosphor on a separate second area. In another embodiment, different types of phosphors, e.g., red and green, may be located on different areas on the sidewall insert 107. For example, one type of phosphor may be patterned on the sidewall insert 107 at a first area, e.g., in stripes, spots, or other patterns, while another type of phosphor is located on a different second area of the sidewall insert 107. If desired, additional phosphors may be used and located in different areas in the cavity 109. Additionally, if desired, only a single type of wavelength converting material may be used and patterned in the cavity 109, e.g., on the sidewalls.

Figure 10:
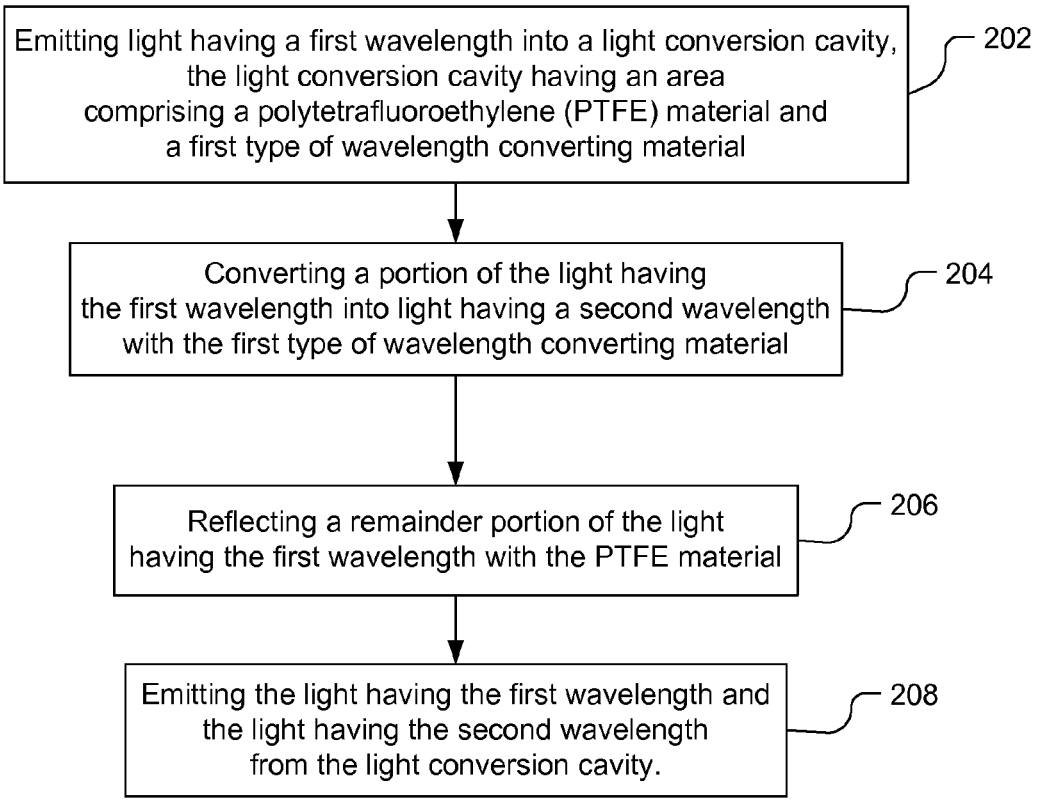
FIG. 10 is a flow chart illustrating a process of using the polytetrafluoroethylene (PTFE) material with wavelength converting material in an illumination module.

FIG. 10 is a flow chart illustrating a process of using the polytetrafluoroethylene (PTFE) material with wavelength converting material in an illumination module. As illustrated, light is emitted having a first wavelength into a light conversion cavity, the light conversion cavity having an area comprising a polytetrafluoroethylene (PTFE) material and a first type of wavelength converting material (202). A portion of the light having the first wavelength is converted into light having a second wavelength with the first type of wavelength converting material (204). A remainder portion of the light having the first wavelength is reflected with the PTFE material (206). The light having the light having the first wavelength and the light having the second wavelength are emitted from the light conversion cavity (208). If desired, the process may further include converting a second portion of the light having the first wavelength into light having a third wavelength with a second type of wavelength converting material, wherein the light having a third wavelength is emitted from the light conversion cavity with the light having the first wavelength and the light having the second wavelength.

Although certain specific embodiments are described above for instructional purposes, the teachings of this patent document have general applicability and are not limited to the specific embodiments described above. For example, FIGS. 4A and 4B illustrate the side walls as having a linear configuration, but it should understood that the sidewalls may have any desired configuration, e.g., curved, non-vertical, beveled etc. For example, a higher transfer efficiency is achieved through the light mixing cavity 109 by pre-collimation of the light using tapered side walls. In another example, cavity body 105 is used to clamp mounting board 104 directly to mounting base 101 without the use of mounting board retaining ring 103. In other examples mounting base 101 and heat sink 130 may be a single component. In another example, LED based illumination module 100 is depicted in FIGS. 1 and 2 as a part of a luminaire 150. As such, LED based illumination module 100 may be an LED based replacement lamp or retrofit lamp or part of a replacement lamp or retrofit lamp. Accordingly, various modifications, adaptations, and combinations of various features of the described embodiments can be practiced without departing from the scope of the invention as set forth in the claims.

What is claimed is:

1. An LED based illumination device comprising:

a light source sub-assembly having a plurality of Light Emitting Diodes (LEDs) mounted on an LED mounting board; and a light conversion sub-assembly configured to mix and color convert light emitted from the light source sub-assembly, wherein a first portion of the light conversion sub-assembly is a polytetrafluoroethylene (PTFE) material, wherein the first portion includes a bottom reflector disposed over the LED mounting board, and wherein a second portion of the light conversion sub-assembly is an output port that includes a first type of wavelength converting material that is physically separated from the plurality of LEDs.

2. The LED based illumination device of claim 1, wherein the first portion of the light conversion sub-assembly includes a second type of wavelength converting material.

3. The LED based illumination device of claim 1, wherein the first portion includes a sidewall that includes a PTFE material.

4. The LED based illumination device of claim 1, wherein a reflective backing layer is disposed adjacent to the first portion.

5. The LED based illumination device of claim 2, wherein the first portion and the output window are replaceable inserts selected for their color conversion properties.

6. The LED based illumination device of claim 1, wherein the output port includes a second type of wavelength converting material.

7. An LED based illumination device comprising:

a light source sub-assembly having a plurality of Light Emitting Diodes (LEDs) mounted in a first plane; and a light conversion sub-assembly mounted adjacent to the first plane and configured to mix and color convert light emitted from the light source sub-assembly, wherein the light conversion sub-assembly comprises a sidewall and a bottom reflector comprising a polytetrafluoroethylene (PTFE) material and an output port including a first wavelength converting material, wherein the first wavelength converting material is physically separated from the plurality of LEDs.

8. The LED based illumination device of claim 7, wherein the output port includes a second type of wavelength converting material.

9. The LED based illumination device of claim 7, wherein the sidewall includes a second type of wavelength converting material.

10. The LED based illumination device of claim 7, wherein a reflective backing layer is disposed adjacent to the sidewall and bottom reflector.

11. The LED based illumination device of claim 9, wherein the interior surface of the sidewall and the output port are replaceable inserts selected for their color conversion properties.

12. The LED based illumination device of claim 7, wherein the plurality of LEDs are mounted in the first plane in a hexagonal arrangement, wherein each LED is equidistant from each immediately neighboring LED.

13. The LED based illumination device of claim 8, wherein a first portion of the output port includes the first wavelength converting material and a second portion of the output port includes the second wavelength converting material.

14. The LED based illumination device of claim 7, wherein light scattering particles are mixed with the first type of wavelength converting material.

15. The LED based illumination device of claim 9, wherein the output port includes a third type of wavelength converting material.

16. The LED based illumination device of claim 8, further comprising:

light scattering particles comprising a layer of the output port.

17. The LED based illumination device of claim 8, wherein a first portion of the output port includes the first wavelength converting material and a second portion of the output port includes the third wavelength converting material.

18. A method comprising:

emitting light having a first wavelength into a light conversion cavity, the light conversion cavity having a bottom reflector insert comprising a polytetrafluoroethylene (PTFE) material and an output port including a first type of wavelength converting material;

converting a portion of the light having the first wavelength into light having a second wavelength with the first type of wavelength converting material;

reflecting a remainder portion of the light having the first wavelength with the PTFE material; and emitting the light having the first wavelength and the light having the second wavelength from the light conversion cavity through the output port.

19. The method of claim 18, further comprising:

converting a second portion of the light having the first wavelength into light having a third wavelength with a second type of wavelength converting material, wherein the light having a third wavelength is emitted from the output port with the light having the first wavelength and the light having the second wavelength.

20. The method of claim 19, wherein the output port includes the second type of wavelength converting material.

* * * * *